United States Patent [19]

Smith

[11] 4,024,584

[45] May 24, 1977

[54] PAD AND GARMENT ASSEMBLY

[75] Inventor: William Lee Smith, Florissant, Mo.

[73] Assignee: A-T-O Inc., Willoughby, Ohio

[22] Filed: July 22, 1976

[21] Appl. No.: 707,816

[52] U.S. Cl. ..... 2/24; 2/22

[51] Int. Cl.[2] ..... A41D 13/06

[58] Field of Search ..... 2/22, 23, 24, 62, 16, 2/20, 2; 128/165, 80 C

[56] References Cited

UNITED STATES PATENTS

| | | | |
|---|---|---|---|
| 545,273 | 8/1895 | Dowling | 2/62 |
| 1,436,537 | 11/1922 | Rylander | 2/24 |
| 1,526,417 | 2/1925 | Goldsmith | 2/2 |
| 1,602,454 | 10/1926 | Riddell | 2/23 |
| 3,266,058 | 8/1966 | Guttman | 2/16 X |
| 3,465,365 | 9/1969 | Jones et al. | 2/24 |
| 3,670,339 | 6/1972 | Cooper et al. | 2/22 |

FOREIGN PATENTS OR APPLICATIONS

| | | | |
|---|---|---|---|
| 1,104,466 | 4/1961 | Germany | 2/24 |

*Primary Examiner*—Alfred R. Guest

*Attorney, Agent, or Firm*—Koenig, Senniger, Powers and Leavitt

[57] ABSTRACT

A pad and garment assembly comprising a pad adapted to be worn on the wearer's body in conjunction with a garment. The pad has a pair of laterally extending ears and the garment has means for receiving the ears detachably to secure the pad to the garment.

10 Claims, 4 Drawing Figures

PAD AND GARMENT ASSEMBLY

BACKGROUND OF THE INVENTION

This invention relates to a pad and garment assembly, and more particularly to a means for securing a leg pad to an athletic garment.

Athletes from a variety of sports have been plagued in the past by problems with their athletic equipment. One such problem involves athletic stockings which are commonly part of an athlete's uniform and which extend up to the knee of the wearer. In attempting to hold these stockings up during the course of a sporting event, the athlete has heretofore used a plurality of devices, all of which have proven to be ineffective in varying degrees. Typically, adhesive tape has been wrapped around the top of stockings for holding the stockings up on the leg, but this method restricts the muscles and the blood circulation in the leg, thereby reducing both the athlete's comfort and maneuverabilty. Moreover, the use of adhesive tape requires excessive wrapping time and undue expense since the stockings need to be retaped to the athlete's leg prior to each game and again during the game itself if the stockings slip down.

A further problem especially prevelant in the sport of football involves maintaining a leg pad, particularly a knee pad, in proper position on the leg of the athlete during competition. Conventionally, the knee pad is positioned in a pocket on the inside of the athletic pants adjacent the knee and extends from a position below the kneecap to a position adjacent the thigh pad. When the athlete bends his leg, however, the pants leg and knee pad therein are pulled upwardly, thereby leaving the lower portion of the knee unprotected and easily susceptible to contusions, abrasions and other types of injury.

SUMMARY OF THE INVENTION

Among the several objects of this invention may be noted the provision of an improved pad and garment assembly wherein the pad is a leg pad and the garment is simply and reliably held in place by the leg pad without use of tape, garters or the like; the provision of such an assembly wherein the pad is readily securable to and removable from the garment; the provision of such an assembly which is comfortable to wear and which does not restrict the blood circulation or maneuverability of the wearer; the provision of such an assembly wherein the leg pad remains properly positioned on the leg for the protection thereof even when the leg is repeatedly flexed; the provision of such an improved assembly which is held in proper position by a leg of a pair of pants, particularly athletic pants of the type having legs terminating generally at the knee; the provision of a leg pad and garment assembly which is simple in design for economical manufacture and which is also pleasing in appearance; the provision of such an assembly wherein the garment is a stocking and the pad is a knee pad for holding the stocking up on the leg; and the provision of such an assembly wherein the pad is a tendon pad and the garment is a pair of athletic pants having means for securing the pad thereto.

Briefly, a pad and garment assembly of this invention comprises a pad adapted to be worn on the wearer's body in conjunction with a garment. The pad has laterally extending ears and the garment has means for receiving the ears detachably to secure the pad to the garment.

Other objects and features will be in part apparent and in part pointed out hereinafter.

BRIEF DESCRIPTION OF THE DRAWINGS

Corresponding reference characters indicate corresponding parts throughout the drawing.

DESCRIPTION OF A PREFERRED EMBODIMENT

Figure 1:
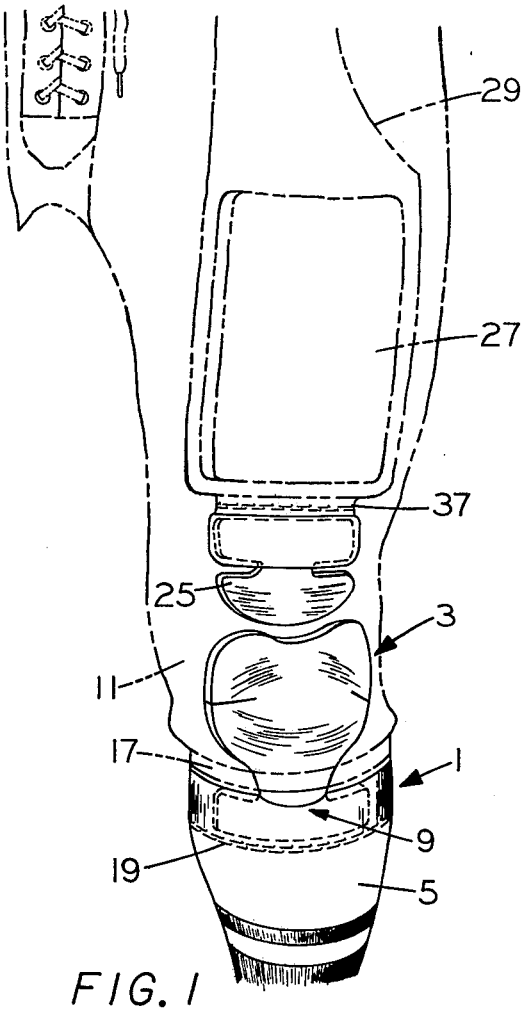
FIG. 1 is a front elevational view of the knee pad and stocking assembly of this invention worn in conjunction with a pair of athletic pants.
Figure 2:
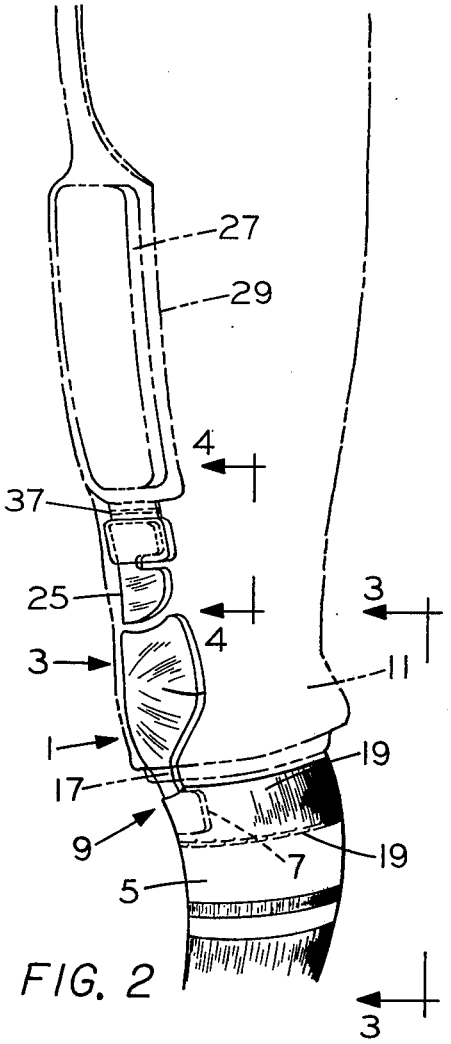
FIG. 2 is a right side elevational view of FIG. 1.
Figure 3:
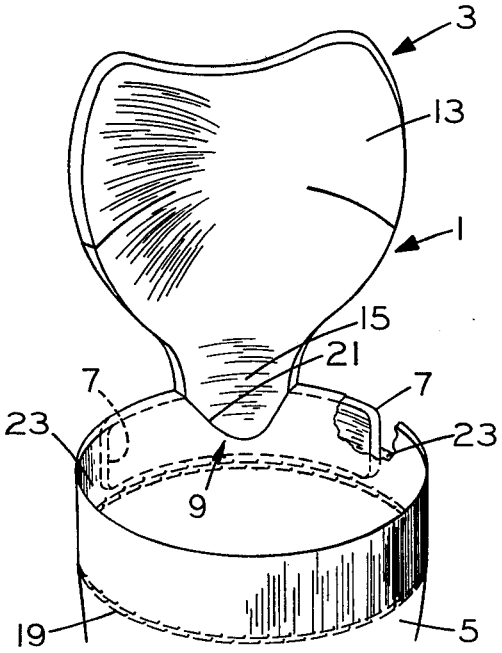
FIG. 3 is an enlarged vertical section taken on line 3—3 of FIG. 2 showing the knee pad in the stocking.

Referring to the drawings, first to FIGS. 1-3, a pad and garment assembly of this invention, generally indicated at 1, is shown to comprise a knee pad 3 to which is secured an athletic stocking 5. The knee pad 3 may be fabricated from any suitable closed cell rubber-like foam material and has a pair of laterally extending ears each designated 7 at its bottom. The stocking 5, which may be knit of any suitable commercially available stretch yarn, has means generally designated 9 at its upper end for receiving the ears detachable to secure the knee pad to the stocking.

More particularly, the knee pad 3 comprises a main body portion 13 for covering the knee, this portion 13 being of diminishing width at its lower end forming a relatively narrow stem 15. As shown in FIG. 3, an enlarged end portion at the lower end of stem 15 forms the ears 7 for insertion in the receiving means 9 of stocking 5. Portion 13 of the knee pad is preferably formed to conform to the shape of the knee and is worn beneath a pair of conventional football pants 11 (see FIGS. 1 and 2). The lower elastic edge 17 of a leg of pants 11 encircles the leg, being received in the notches between the pad and the ears, and binds the pad at stem 15 to the leg of the wearer for holding the pad in place on the knee of the wearer. The upper edge of knee pad 3 is concave in shape for allowing greater freedom of movement to the leg.

The means 9 at the upper end of stocking 5 for receiving the ears 7 of the knee pad comprises a cuff or hem generally designated 19 at the top of the stocking having an opening 21 therein for receiving the stem 15. The hem forms a pair of pockets each designated 23 interconnected at their mouths, with opening 21 generally at the interconnection between the pockets for receiving the stem 15 of the knee pad with each ear extending into its respective pocket 23, thereby to secure the stocking to the knee pad. The opening 21 in the inner layer of the hem 19 is preferably triangular in shape, decreasing in width toward the lower edge of the hem, but it is understood that other shapes may also be suitable.

As best shown in FIG. 1, the pad 3 is held on the wearer's body by pants 11 with ears 7 in position corresponding to the position of the upper end of stocking 5. Ears 7 are then inserted into their respective pockets 23 at the upper end of the stocking for detachably securing the stocking to the pad. In this manner, the stocking is simply and reliably held up on the leg without the use of tape or other accessories which tend to restrict blood circulation and maneuverability. Moreover, since the upward and downward movement of the knee pad is limited by stocking 5 and pants 11, respectively, the knee pad is held in proper position on the wearer's knee even when the knee is repeatedly flexed. Thus, the knee is protected at all times for preventing contusions, abrasions and other types of injuries. It will readily be seen that the knee pad and stocking assembly of the present invention is easy to assemble and disassemble and comfortable to wear. Further, the assembly is pleasing in appearance and simple in design for economical manufacture.

Figure 4:
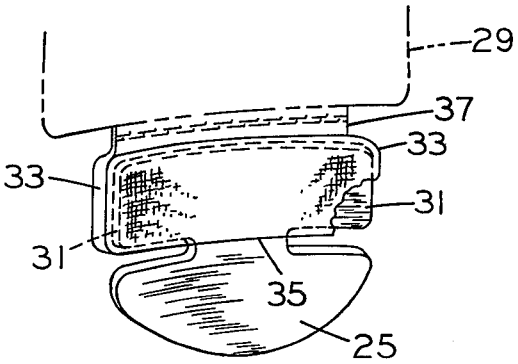
FIG. 4 is an enlarged vertical section taken on line 4—4 of FIG. 2 showing a tendon pad secured to the athletic pants in accordance with this invention.

FIGS. 1, 2 and 4 show a tendon pad 25 (which may be formed of the same material as knee pad 3) secured to athletic pants 11 in accordance with this invention. This tendon pad is worn on the leg above knee pad 5 and below a conventional thigh pad 27 which is typically held in a pocket 29 sewn to a leg of pants 11. The pad 25 has two ears, each designated 31, one ear being located at each side of the pad at its upper end. A pair of pockets 33 interconnected at their mouths, and an opening 35 generally at the interconnection between the pockets receive the tendon pad whereby with each ear 31 extending into its respective pocket 33, the pad is positioned for protecting the portion of the leg between the knee pad 3 and the thigh pad 27. As indicated at 37, pockets 33 are stitched to the bottom of pocket 29 although it is understood that they could also be secured directly to a leg of the pants.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. A pad and garment assembly comprising a pad adapted to be worn on the wearer's body in conjunction with a garment, said pad having a pair of laterally extending ears and said garment having means for receiving the ears detachably to secure the pad to the garment.

2. A pad and garment assembly as set forth in claim 1 wherein said pad receiving means comprises a pair of pockets interconnected at their mouths and an opening generally at said interconnection for receiving said ears whereby with each ear in its respective pocket the pad is secured to the garment.

3. A pad and garment assembly as set forth in claim 1 wherein said garment is a stocking and said pad is adapted to be held on the wearer's leg with the ears in position corresponding to the position of the upper end of the stocking pulled up onto the leg, the stocking having receiving means for the ears at its upper end detachably to secure the upper end of the stocking to the pad and thus hold the stocking up on the leg.

4. A pad and garment assembly as set forth in claim 3 wherein said pad receiving means comprises a pair of pockets interconnected at their mouths and an opening generally at said interconnection for receiving said ears whereby with each ear in its respective pocket the pad is secured to the garment.

5. A pad and garment assembly as set forth in claim 4 wherein said pockets are formed by a hem at the top of said stocking.

6. A pad and garment assembly as set forth in claim 3 wherein the pad is a knee pad conforming to the shape of the knee and said ears are at the lower end of the pad.

7. A pad and garment assembly as set forth in claim 3 wherein the pad has a main body portion for covering the knee, said main body portion being of a diminishing width at its lower end forming a stem, and an enlarged end portion at the lower end of the stem forming said ears for insertion into the stocking, said main body portion of the pad being adapted to be worn on the knee beneath a pair of pants with the lower end of a leg of the pair of pants binding the pad at the stem to the leg of the wearer for holding the pad in place on the knee of the wearer.

8. A pad and garment assembly as set forth in claim 3 wherein the upper edge of said pad is of concave form.

9. A pad and garment assembly as set forth in claim 2 wherein the pad has one of said ears at each side of the pad at its upper end.

10. A pad and garment assembly as set forth in claim 9 wherein the garment is a pair of pants and said pockets are in a pants leg whereby the pad is positioned for protecting the front upper portion of the wearer's leg.

* * * * *